US006975818B2

(12) United States Patent
Lee

(10) Patent No.: US 6,975,818 B2
(45) Date of Patent: Dec. 13, 2005

(54) IMAGE FORMATION DEVICE USING AN I²C BUS AND A CONTROL METHOD THEREOF

(75) Inventor: Chang-bok Lee, Suwon (KR)

(73) Assignee: Samsung Electronics Co. Ltd., (KR)

( * ) Notice: Subject to any disclaimer, the term of this patent is extended or adjusted under 35 U.S.C. 154(b) by 123 days.

(21) Appl. No.: 10/697,980

(22) Filed: Oct. 31, 2003

(65) Prior Publication Data

US 2004/0165905 A1 Aug. 26, 2004

(30) Foreign Application Priority Data

Feb. 24, 2003 (KR) ..... 10-2003-0011413

(51) Int. Cl.[7] ..... G03G 15/00
(52) U.S. Cl. ..... 399/75; 399/9; 399/38
(58) Field of Search ..... 399/9, 38, 75, 399/76, 77; 358/1.1, 500, 501, 400, 401, 358/296

(56) References Cited

U.S. PATENT DOCUMENTS 5,920,407 A * 7/1999 Erickson et al. ..... 358/504
2004/0124871 A1 * 7/2004 Selz et al. ..... 326/21
2004/0177195 A1 * 9/2004 Buckland et al. ..... 710/300

* cited by examiner

*Primary Examiner*—Sophia S. Chen
(74) *Attorney, Agent, or Firm*—Roylance, Abrams, Berdo & Goodman, L.L.P.

(57) ABSTRACT

An image formation device using an I²C bus and a control method therefor. The image formation device includes a plurality of detection sensors for detecting operation states of the peripheral devices; a plurality of A/D conversion units for converting into digital signals detection result signals output from the plurality of detection sensors; a plurality of slave devices for separating and storing by detection sensor the detection result signals converted into the digital signals by the A/D conversion units, and sending the stored detection result signals according to a signal requesting detection results; and a master device for requesting to the slave devices the detection result signal from at least one detection sensor out of the plurality of detection sensors in order to verify the operation states of the peripheral devices, such that the slave devices and the master device send and receive data to and from each other through a serial bus.

6 Claims, 4 Drawing Sheets

IMAGE FORMATION DEVICE USING AN $I^2C$ BUS AND A CONTROL METHOD THEREOF

This application claims the benefit of Korean Application No. 2003-11413, filed Feb. 24, 2003, in the Korean Intellectual Property Office, the disclosure of which is incorporated herein by reference.

BACKGROUND OF THE INVENTION

1. Field of the Invention

The present invention relates to an image formation device and a control method thereof, and more particularly to an image formation device with peripheral circuits simplified by connecting peripheral devices with an $I^2C$ bus sharing and a control method thereof.

2. Description of the Related Art

In general, a printer is the most common image printing device which outputs, in visible form, information processed in external devices, such as computers or scanners.

In general, image formation devices such as facsimile, printer, photocopier, (and combination machines incorporating these devices and functions into one device) are all products manufactured in common to have a printing function.

FIG. 1 is a view schematically showing a connecting structure of a conventional image formation device.

Referring to FIG. 1, the image formation device 100 has a operation panel unit 110, a power supply 120, a high voltage power supply (HVPS) 130, a printing engine unit 140, a motor driving unit 150, plural detection sensors S1 to Sn, and a main controller 160.

The operation panel unit 110 is provided with a key input part (not shown) having a plurality of function keys enabling users to set or select functions supported by the image formation device 100. Further, the operation panel unit 110 has a display part (not shown) displaying operation states of the image formation device 100 according to the settings of the controls of the main controller 170.

The power supply 120 generates electric power to drive the operation panel unit 110, the HVPS 130, the print engine unit 140, the motor driving unit 150, the plural detection sensors S1 to Sn, and the main controller 160.

The HVPS 130 supplies a charging voltage, a developing voltage, and a transfer voltage to a charging roller, a developing roller, and a transfer roller, respectively, which are the components of the print engine unit 140.

The print engine unit 140 is controlled by the main controller 160, and has numerous mechanical parts, such as a charging part for charging the photosensitive drum to a predetermined voltage, a laser scanning unit for scanning the photosensitive drum with light, a developing part for supplying toner onto a latent image formed on the photosensitive drum by the laser scanning unit and forming a toner image, a transfer part for transferring the toner image formed on the photosensitive drum onto a recording sheet of paper, and a fusing part for fixing the transferred image on the recording sheet by the transfer part.

The motor driving unit 150 controls the driving of various motors for driving the print engine unit 140 according to the controls of the main controller 160.

The main controller 160 controls the overall operations of the image formation device 100 according to a control program stored in a memory part (not shown). Further, the main controller 160 is provided with an EEPROM 162 for storing initial conditions, control setting values, or the like, of the image formation device 100.

Further, the image formation device 100 is provided with a plurality of detection sensors, S1 to Sn, for detecting the operation states of the image formation device 100. For example, the plural detection sensors S1 to Sn include diverse sensors for detecting the operation states of the print engine unit 140. These can include a jam sensor for detecting paper jams, a paper position sensor for detecting whether paper arrives at a predetermined reference position, a cover opening sensor for detecting the opening of a cover, a temperature sensor for detecting a fusing temperature, and so on.

Such detection sensors S1 to Sn are separately harness-connected to the main controller 160, to transmit their detection result signals to the main controller 160. In addition, even the operation panel unit 110, solenoids, or various switching elements are harness-connected to communicate data with the main controller 160.

The components communicating data with the main controller 160 are connected through a 2- or 3-wire harness to the main controller 160 for data communications. However, there exists a problem in that the length of the harness becomes longer as the sensors or the switching elements are placed farther from the main controller 160, since the sensors or the switching elements are placed at fixed locations. Further, various kinds of harnesses, and/or multiple or long wires of the harness may cause electromagnetic interference (EMI) or the electrostatic discharge (ESD).

Thus, the conventional image formation device has various problems which cause an increase in raw material costs, an increase in the number of assembly processes, both of which complicates the assembly process.

SUMMARY OF THE INVENTION

An object of the present invention is to substantially solve at least the above problems and/or disadvantages and to provide at least the advantages described below. Accordingly, it is an object of the present invention to provide an image formation device with peripheral circuits simplified by connecting them with an $I^2C$ bus sharing and a control method thereof.

In order to achieve the above aspect, an image formation device in which data communications are controlled between peripheral devices performing print jobs and a main controller controlling the peripheral devices, according to an embodiment of the present invention, comprises plural detection sensors for detecting operation states of the peripheral devices, and an A/D conversion unit for converting into digital signals detection result signals output from the plurality of detection sensors. The image formation device further comprises a slave device for separating and storing by detection sensor. The detection result signals are converted into digital signals by the A/D conversion unit. The stored detection result signals are transmitted according to a signal requesting detection results. The image formation device also comprises a master device for requesting to the slave device the detection result signal of at least one detection sensor out of the plurality of detection sensors in order to verify the operation states of the peripheral devices, wherein the slave device and the master device send and receive data to and from each other through a serial bus. In the preferred embodiment of the invention, the serial bus is an $I^2C$ bus for data communications through a data bus line and a clock bus line.

The image formation device further comprises a display unit for displaying the operation states of the image formation device, and a key input unit for enabling users to select and set functions supported by the image formation device. The display unit and the key input unit communicate with the master device through the $I^2C$ bus.

Preferably, each slave device includes a communication protocol for performing communications with the master device, and registers for storing detection sensor signals. The detection sensors output an analog signal which is converted by the A/D conversion unit into digital signals and are then stored in the registers.

A further object of an embodiment of the present invention provides a control method for an image formation device having a plurality of detection sensors for detecting operation states of peripheral devices, an A/D conversion unit for converting detection result signals into digital signals, a slave device for separating and storing the detection result signals by detection sensor, and a master device connected to the slave device through a serial bus and for controlling the slave device. The control method comprises the steps of detecting the operation state of the peripheral devices, converting the detection result signals into digital signals by the a plurality of detection sensors, and separating and storing, by detection sensor, the detection result signals converted into digital signals. Further, the method comprises the steps of deciding whether to receive a signal requesting the detection result of at least one detection sensor out of the plurality of detection sensors from the master device, and sending to the master device the detection result signals corresponding to the detection result request signal, if it is decided that the detection result request signal is received in the decision step.

BRIEF DESCRIPTION OF THE DRAWINGS

The novel features believed characteristic of the invention are set forth in the appended claims. The invention itself, however, as well as other features and advantages thereof will be best understood by reference to the detailed description of the preferred embodiments which follows, when read in conjunction with the accompanying drawings, in which:

DETAILED DESCRIPTION OF THE PREFERRED EMBODIMENT

Figure 1:
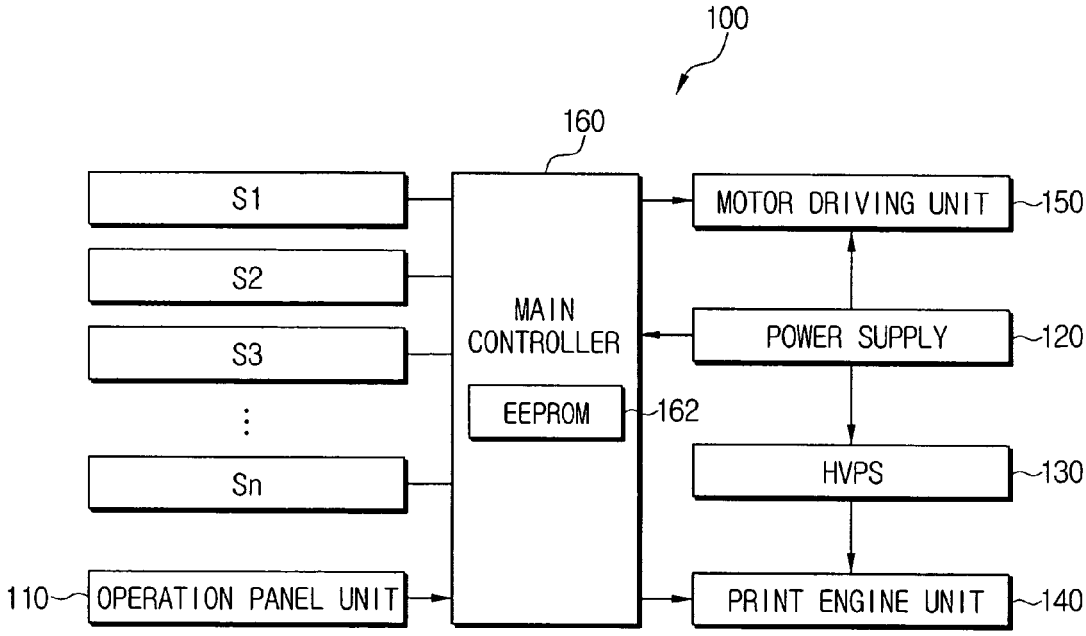
FIG. 1 (PRIOR ART)
FIG. 1 is a block diagram of the major components of a conventional image formation device.

Several embodiments of the present invention will now be described in detail with reference to the annexed drawings. In the drawings, the same or similar elements are denoted by the same reference numerals even though they are depicted in different drawings. In the following description, a detailed description of known functions and configurations incorporated herein have been omitted for conciseness.

Figure 2:
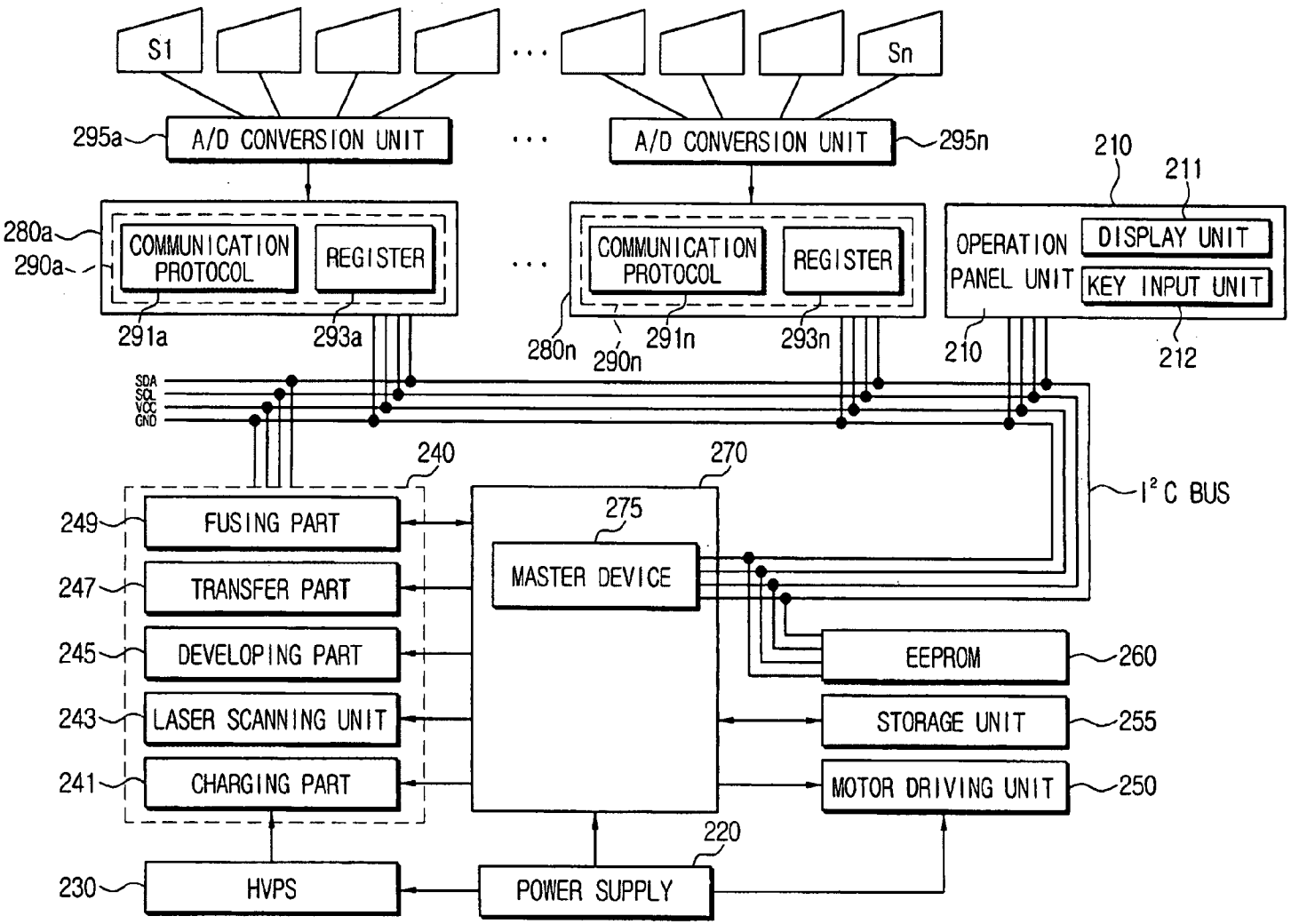
FIG. 2 is a block diagram of the major components of an image formation device according to a preferred embodiment of the present invention.

FIG. 2 is a block diagram of the major components of an image formation device according to a preferred embodiment of the present invention. Referring to FIG. 2, an image formation device 200 according to an embodiment of the present invention has an operation panel unit 210, a power supply 220, a high voltage power supply (HVPS) 230, a print engine unit 240, a motor driving unit 250, slave devices 290*a* to 290*n*, A/D conversion units 295*a* to 295*n*, a plurality of detection sensors S1 to Sn, and a main controller 270.

The operation panel unit 210 and the slave devices 290*a* to 290*n* are connected to the main controller 270 through an $I^2C$ bus, which is a serial bus. The operation panel unit 210 is provided with a key input part 212, which has a plurality of function keys for enabling users to select and set the functions supported by the image formation device 200, and a display part 211, for displaying operation states of the image formation device 200, according to the controls of the main controller 270, which will be described in greater detail below.

The power supply 220 generates and supplies driving voltages to several components, such as the operation panel unit 210, HVPS 230, motor driving unit 250, print engine unit 240, detection sensors S1 to Sn, and the main controller 270. However, FIG. 2 illustrates the power supply paths only for a portion of the components from the power supply 220 in order to avoid complicating the drawing.

The HVPS 230 supplies predetermined voltages to several of the components constructing the print engine unit 240. These include, for example, the charging roller 241, developing roller 245, and transfer roller 247. The voltages are supplied in accordance with controls issued by the main controller 270.

The print engine unit 240 performs print jobs, with data to be printed, according to controls issued by the main controller 270.

As shown in FIG. 2, the print engine unit 240 has a charging part 241, a laser scanning unit 243, a developing part 245, a transfer part 247, and a fusing part 249.

The charging part 241 charges the photosensitive drum (not shown), applied with a photosensitive medium, to a predetermined voltage.

The laser scanning unit 243 scans the photosensitive drum with light (a laser) corresponding to printing data issued by the controls of the main controller 270.

The developing part 245 develops an electrostatic latent image, formed on the photosensitive drum by the laser scan unit 243, with charged toner to form a toner image.

The transfer part 247 transfers to a recording sheet of paper the toner image formed on the photosensitive drum.

The fusing part 249 fixes the image transferred on the recording sheet by the transfer part 247. The recording sheet fixed by the fusing part 249 is discharged along a discharge direction. The fusing part 249, according an embodiment to the present invention, is connected to the main controller 270 through an $I^2C$ bus as shown in FIG. 2 so as to send information on a fusing temperature to the main controller 270, and receive predetermined control signals from the main controller 270.

The motor driving unit 250 controls the driving of rollers (or motors) to drive the print engine unit 240 according to the controls issued by the main controller 270.

A storage unit 255 includes a ROM storing control programs and various application programs for driving the main controller 270, and a RAM for temporarily storing data resulting from program executions of the main controller 270, and data occurring during printing procedures.

An EEPROM 260 stores initial conditions or control setting values for the image formation device 200, control data for the print engine unit 240, and setting values for setting operation states. Further, the EEPROM 260 stores address information on slave devices 290*a* to 290*n*, communicating data with the master device 275 through the $I^2C$ bus, and data to be sent to and from the slave devices 290*a* to 290*n*. The EEPROM 260 is controlled by the main controller 270, and connected to the main controller 270 through the $I^2C$ bus.

When the image formation device 200 is powered on by the power supply 220, the main controller 270 performs the overall operations of the image formation device 200 according to the control programs stored in the storage unit 255.

The main controller 270 includes a master device 275 controlling the $I^2C$ bus which supports data communications with peripheral devices. In one embodiment of the present invention, the master device 275 is embedded in the main controller 270. However, the master device 275 can be externally connected to the main controller 270. Further, the main controller 270 can receive output signals from the master device 275 and then verify operation states of peripheral devices connected to the $I^2C$ bus, as well as control corresponding devices through the master devices 275.

The master device 275 is authorized to use the $I^2C$ bus, and controls the slave devices 290*a* to 290*n* connected through the $I^2C$ bus. The master device 275 sends various control signals to the slave devices 290*a* to 290*n* through the $I^2C$ bus, and accordingly, receives signals sent from the slave devices 290*a* to 290*n*, thereby enabling bilateral communications between the master device 275 and the slave devices 290*a* to 290*n*.

The detection sensors S1 to Sn, detect operation states of the image formation device 200. The detection sensors for detecting operation states of the image formation device 200 can include a jam detection sensor for detecting paper jams, a paper position detection sensor for detecting whether paper arrives at a set reference position, a cover opening detection sensor for detecting the opening of a cover, a temperature detection sensor for detecting a fusing temperature of the fusing part 249, and so on. The individual detection sensors S1 to Sn output their detection result signals to the A/D conversion units 295*a* to 295*n*, described in greater detail below.

The A/D conversion units 295*a* to 295*n* convert into digital signals the detection result signals output from the plural detection sensors S1 to Sn. In general, the detection sensors detect the operation states of devices in an analog fashion, so that the A/D conversion units 295*a* to 295*n* convert the analog detection result signals into digital signals that the main controller 270 can recognize. Accordingly, if the plural detection sensors S1 to Sn are digital detection sensors, the conversion process is not performed.

The slave devices 290*a* to 290*n* are connected to the master device 275 through the $I^2C$ bus, and connected to the output terminals of the A/D conversion units 295*a* to 295*n* to input detection result signals from the detection sensors S1 to Sn.

The slave devices 290*a* to 290*n* consist of communication protocols 291*a* to 291*n* and registers 293*a* to 293*n*, respectively.

The communication protocols 291*a* to 291*n* communicate data with the master device 275, and decode and store into the registers 293*a* to 293*n*, data sent from the master device 275. The communication protocols 291*a* to 291*n* also read out, and send to, the master device 275, data stored in the registers 293*a* to 293*n*.

The registers 293*a* to 293*n* separate and store, by sensor S1 to Sn, digital signals output from the A/D conversion units 295*a* to 295*n*, according to the detection result signals detected by the plural detection sensors S1 to Sn.

Further, the slave devices 290*a* to 290*n* each have a unique address. Accordingly, when the master device 275 attempts to communicate with the slave devices 290*a* to 290*n* connected through the $I^2C$ bus, the master device 275 performs data communications by using the address information assigned to the respective slave devices 290*a* to 290*n*.

Slave devices 290*a* to 290*n*, according to an embodiment of the present invention, are connected with to-be-connected devices, such as the plural detection sensors S1 to Sn or the A/D conversion units 295*a* to 295*n*, through intermediate connection boards 280*a* to 280*n*.

As shown in FIG. 2, the master device 275 and the slave devices 290*a* to 290*n* are mutually connected through the $I^2C$ bus. The $I^2C$ bus includes a serial data line (SDA) for sending data in serial, and a serial clock line (SCL) for sending clock signals. Further, the $I^2C$ bus includes a power supply line VCC and a ground line GND.

Figure 3A:
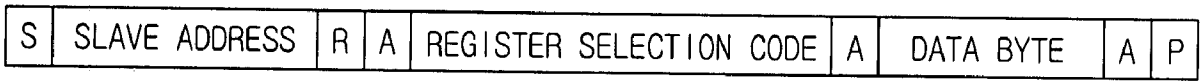
FIGS. 3A and 3B illustrate data communications on an $I^2C$ bus when reading and writing data from and to storage registers.

Data communications between the master device 275 and the slave devices 290*a* to 290*n* through the $I^2C$ bus will now be described in reference to FIGS. 3A and 3B.

A description will first be made regarding the process for the master device 275 to access data stored in the registers 293*a* to 293*n* of the slave devices 290*a* to 290*n* with reference to FIG. 3*a*. The master device 275 changes the level of the SDA from a high level to a low level while maintaining the SCL in the high level, and sends to the slave devices 290*a* to 290*n* a start bit S notifying of a data frame start. Next, the master device 275 transmits an address of a destination slave device, such as 290*a* of the plural slave devices 290*a* to 290*n* connected through the $I^2C$ bus. The master device 275 then transmits a read bit R, for selecting a read operation through the $I^2C$ bus. following reception of the R bit, the selected slave device 290*a* sends to the master 275 device an acknowledgement signal A indicating receipt of the communication request signal.

Upon proper receipt of the acknowledgment signed from one selected slave device 290*a*, the master device 275, if destination slave devices 290*a* to 290*n* each have a plurality of associated registers, sends to the slave devices a register selection code to select any of the associated registers. The master device 275 sends to the slave device 290*a* a signal requesting detection results from any of the associated detection sensors S1 to Sn stored in the registers 293*a* to 293*n*. By using the register selection code signal, the master device 275 can request detection result signals to all the detection sensors S1 to Sn, or, otherwise, request the detection result signals for a specified detection sensor from the plurality of detection sensors S1 to Sn.

Following receipt by the slave device 290*a* of a register selection code signal, the slave device 290*a* sends to the master device 275 an acknowledgement signal A notifying the master device 275 of the receipt of the register selection code. In accordance with the $I^2C$ communication protocol, the slave device 290*a* sends to the master device 275 an acknowledgement signal A notifying the master device 275 that the slave device 290*a* has received a predetermined signal from the master device 275. Following receipt from the slave device 290*a* of an acknowledgement signal A, which notifies receipt of the register selection code, the master device 275 can read out data stored in the slave device 290*a*. The slave device 290*a* then sends data to the master device 275, shown as databyte in FIG. 3A, and the master device 275 sends to the slave device 290*a* an acknowledgement signal A indicating receipt of the data. If the data readout procedure is completed, the master device 275 changes the SDA from a low level to a high level while maintaining the SCL in a high level, and generates a signal end code P notifying the end of data communications.

By application of the data access process described above, the master device 275 can access the slave devices 290*a* to 290*n*, and verify operation states of the slave devices 290*a* to 290*n* and peripheral devices such as the plural detection sensors S1 to Sn connected through the slave devices 290*a* to 290*n*. Likewise, the master device 275 can access the operation panel unit 210 and the fusing part 249, and then verify the operation states of the operation panel unit 210 and the fusing part 249.

Figure 3B:
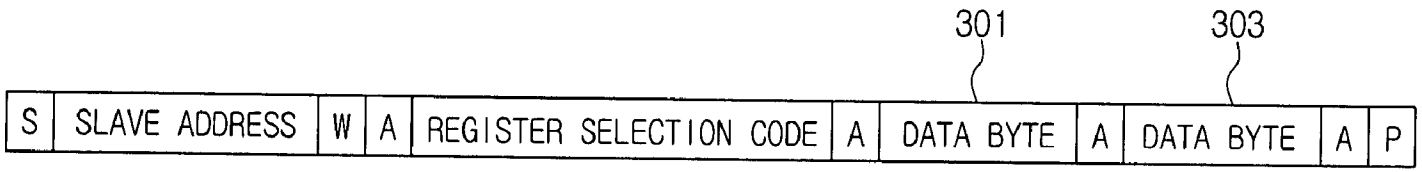

A description will now be presented with regard to the process for writing data from the master device 275 to the slave devices 290*a* to 290*n* with reference to FIG. 3*b*.

The process for writing data from the master device 275 to the slave devices 290*a* to 290*n* begins with the master device 275 sending to a destination slave device 290*a* a start bit S notifying it of a data frame start. This is then followed by the master device 275 transmitting the address of the destination slave device 290*a*, and a write bit W, notifying the slave device 290*a* of a data write. The selected slave device 290*a* responds by sending to the master device 275 an acknowledgement signal A, notifying it of receipt of the communication request signal. After receiving the acknowledgement signal A from the selected slave device 290*a*, the master device 275 sends a register selection code to the slave device 290*a*. Next, the slave device 290*a* sends to the master device 275 an acknowledgement signal A notifying it of receipt of the register selection code. Thereafter, the master device 275 sends write data to the slave device 290*a*. The slave device 290*a* receives the data sent from the master device 275, writes the data into the register, and, then sends to the master device 275 an acknowledgement signal A notifying the master device 275 that the data has been written into the register. After each data word has been acknowledged as written, the master device 275 can send additional data bytes. For example, in FIG. 31, data byte 301 is followed by data byte 303. Lastly, the master device 275 changes the SDA from a low level to a high level while maintaining the SCL in the high level, and generates an end code P notifying that the sending of data has ended.

Figure 4:
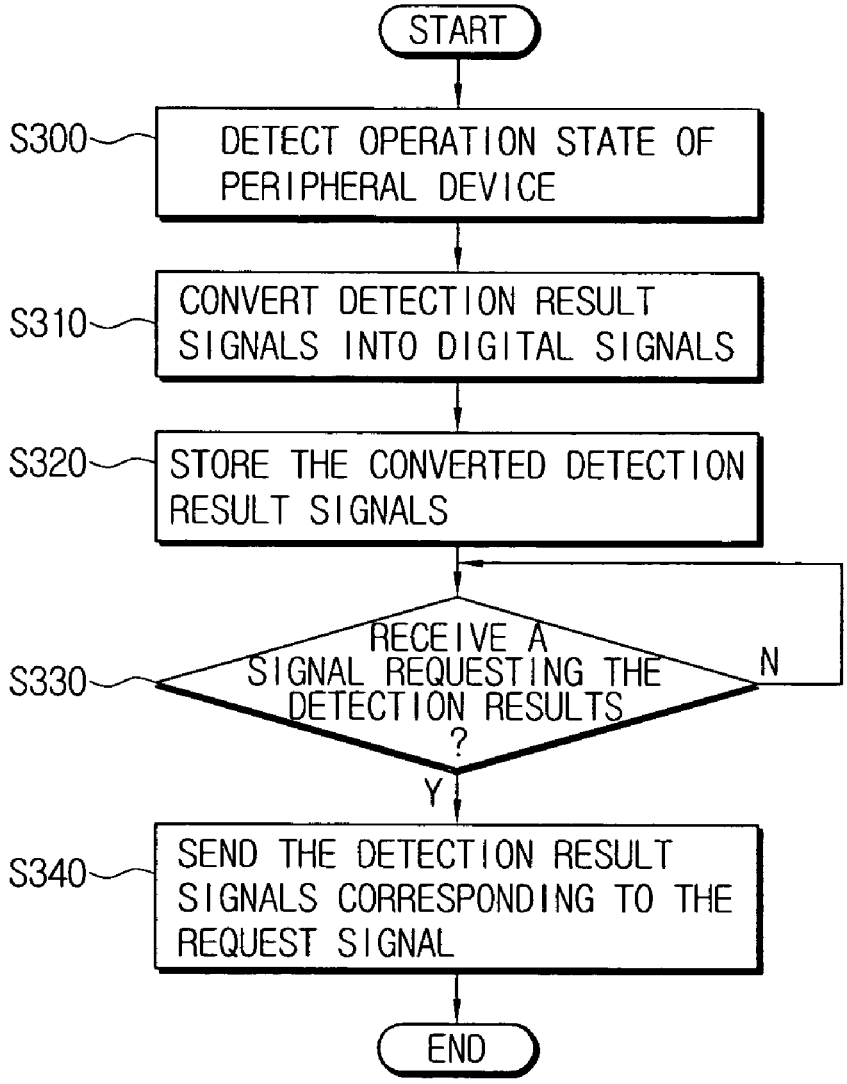
FIG. 4 is a flow chart illustrating steps of a control method for controlling the image formation device shown in FIG. 2.

A control method for the image formation device will now be described according to a preferred embodiment of the present invention with reference to FIG. 4.

The control method begins by detection sensors S1 to Sn detecting operation states of corresponding peripheral devices (step S300). The A/D conversion units 295*a* to 295*n* convert into digital signals detection result signals output from the detection sensors S1 to Sn, and output the digital signals to the slave devices 290*a* to 290*n* (step S310). The communication protocols 291*a* to 291*n* then separate and store into the registers 293*a* to 293*n* the digital detection result (step S320).

With regard to viewing data communication procedures between the master device 275 and the slave devices 290*a* to 290*n*. the master device 275 first selects a destination device, for example, 290*a*, out of the plurality of slave devices 290*a* to 290*n* connected through the $I^2C$ bus. Following this selection, the master device 275 sends to the slave device 290*a* a start bit S notifying of a communication start. The master device 275 then transmits a destination device address and a signal R requesting a detection result signal.

The slave device 290*a* then determines whether the detection result request signal has been received from the master device 275 (decision step S330). If it is decided in the step S330 that the detection result request signal is received from the master device 275 ("Yes" path from decision step S330), the slave device 290*a* sends to the master device 275 an acknowledgement signal A notifying of a receipt of the detection result request signal.

The master device 275 can request at least one detection result signal out of all the detection result signals separated and stored in the register 293*a* by detection sensor. At this time, the master device 275 can request all the detection result signals stored in the register 293*a* of the slave device 290*a*, or request detection result signals corresponding to specified detection sensors.

Accordingly, the slave device 290*a* sends to the master device 275 detecting result signals corresponding to the received detection result request signal transmitted from the master device 275 (step S340). If the detection result signals sent from the slave device 290*a* are completely received, the master device 275 sends to the slave devices 290*a* to 290*n* the acknowledgement signal A notifying that the receipt is completed, generates an end code P indicating that the communications are finished, and ends the data communications with the slave devices 290*a* to 290*n*.

As described, the image information device and the control method according to an embodiment of the present invention can reduce the number of harness or cables in a system by sharing the $I^2C$ serial bus in connecting various detection sensors for detecting operation states of the image formation device, operation panel of input/output device, EEPROM, various switching elements, and so on, in an image formation device. Accordingly, the preferred embodiment of the present invention can reduce material costs and simplify peripheral circuits. Further, the preferred embodiment of the present invention can simplify the assembly process thereby improving manufacturing productivity.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An image formation device which controls data communications between peripheral devices performing printing jobs and a main controller controlling the peripheral devices, the image formation device comprising:

a plurality of detection sensors for detecting operation states of the peripheral devices and outputting detection result signals;

an A/D conversion unit for converting into digital signals the detection result signals output from the detection sensors;

a slave device for separating and storing by detection sensor the detection result signals converted into the digital signals by the A/D conversion unit, and sending the stored detection result signals according to a detection result request signal; and a master device for requesting to the slave device the detection result signal of the at least one of said detection sensors in order to verify the operation states of the peripheral devices, wherein the slave device and the master device send and receive data to and from each other through a serial bus.

2. The image formation device as claimed in claim 1, wherein the serial bus is an $I^2C$ bus for data communications through a data bus line and a clock bus line.

3. The image formation device as claimed in claim 2, further comprising:

a display unit for displaying the operation states of the image formation device; and a key input unit for enabling users to select and set functions supported by the image formation device, wherein the display unit and the key input unit communicate with the master device through the $I^2C$ bus.

4. The image formation device as claimed in claim 3, wherein the slave device includes:

a communication protocol for performing communications with the master device; and registers for storing by detection sensor the digital signals converted by the A/D conversion unit according to the detection result signals.

5. A control method of an image formation device having at least one detection sensor for detecting operation states of peripheral devices, a A/D conversion unit for converting detection result signals into digital signals, a slave device for separating and storing the detection result signals by detection sensor, and a master device connected to the slave devices through a serial bus, for controlling the slave devices, the control method comprising steps of:

using the detector sensor to detect the operation states of the peripheral devices;

using the A/D conversion unit to convert the detection result signals into the digital signals by the at least one detection sensor;

using the slaves device to separate and store by detection sensor the detection result signals converted into the digital signals;

deciding whether to receive a detection result request signal of at least one detection sensor from the master device; and sending to the master device the detection result signals corresponding to the detection result request signal if it is decided that the detection result request signal is received in the decision step.

6. The control method as claimed in claim 5, wherein the serial bus is an $I^2C$ bus for data communications through a data bus line and a clock bus line.

* * * * *